US006171752B1

(12) United States Patent
Baker et al.

(10) Patent No.: US 6,171,752 B1
(45) Date of Patent: Jan. 9, 2001

(54) PHOTOGRAPHIC SILVER HALIDE MATERIAL

(75) Inventors: Julie Baker, Hertfordshire; John M. Higgins, Middlesex, both of (GB)

(73) Assignee: Eastman Kodak Company, Rochester, NY (US)

( * ) Notice: Under 35 U.S.C. 154(b), the term of this patent shall be extended for 0 days.

(21) Appl. No.: 09/208,144

(22) Filed: Dec. 9, 1998

(30) Foreign Application Priority Data

Dec. 9, 1997 (GB) ..... 9725926

(51) Int. Cl.[7] ..... G03C 1/08

(52) U.S. Cl. ..... 430/264; 430/598

(58) Field of Search ..... 430/264, 598

(56) References Cited

U.S. PATENT DOCUMENTS 5,512,415 4/1996 Dale et al. ..... 430/264
5,563,021 * 10/1996 Pich et al. ..... 430/264

FOREIGN PATENT DOCUMENTS 0 727 703 A1 8/1996 (EP) .

* cited by examiner

*Primary Examiner*—Janet Baxter
*Assistant Examiner*—Amanda C. Walke
(74) *Attorney, Agent, or Firm*—Edith A. Rice

(57) ABSTRACT

A photographic material comprises a support bearing at least one silver halide emulsion layer. The material contains in the emulsion layer or an adjacent hydrophilic colloid layer, a nucleating agent. One or more of the layers further comprises a polymeric material capable of partitioning the nucleating agent in order to control nucleation and thereby allow the level of pepper fog and raw stock keeping to be controlled.

8 Claims, 1 Drawing Sheet

PHOTOGRAPHIC SILVER HALIDE MATERIAL

FIELD OF THE INVENTION

The invention relates to photographic silver halide materials and particularly to high contrast photographic silver halide materials, e.g., those of the graphic arts type.

BACKGROUND OF THE INVENTION

It is well known that nucleators (often used in conjunction with supplementary amine "boosters") can be used in photographic materials to provide very high contrast images useful for graphic arts applications. The level of nucleation activity achieved in a material can be modified and the established art is to control the nucleation process by, for example, adjusting the level of, and/or the type of nucleator, in isolation, or in concert with similar kinds of changes to the booster. This is a crude, time-consuming method demanding the development and synthesis of new nucleators and boosters, whereas varying the nucleator level provides only a very limited level of control.

It is important to control the level of nucleation activity not only to ensure high photographic contrast, but also to control the level of "pepper" fog, that is, the number of undesirable black spots in otherwise clear image areas. Also, it is important to control the level of nucleation activity in order to control the rawstock keeping stability of the material.

U.S. Pat. No. 5,512,415 describes a high contrast photographic material comprising a support bearing at least one silver halide emulsion layer wherein the photographic material contains a hydrazine nucleating agent and a polymer latex having a core/shell structure wherein each are incorporated in at least one of the silver halide emulsion layers and other hydrophilic colloid layers of the photographic material. The polymer latex is added to improve the physical properties of the photographic material, e.g., wet film strength or scratch resistance.

A much more refined method of nucleation control is required, allowing the level of pepper fog and raw stock keeping to be controlled to provide the desired product performance.

SUMMARY OF THE INVENTION

The invention provides a photographic material comprising a support bearing at least one silver halide emulsion layer, and containing in the emulsion layer or in an adjacent hydrophilic colloid layer, a nucleating agent, the element further comprising a polymeric material capable of partitioning the nucleating agent.

In this invention a much more refined method of nucleation control is provided, allowing the level of pepper fog and raw stock keeping to be controlled to provide the desired product performance.

DETAILED DESCRIPTION OF THE INVENTION

Figure 1:
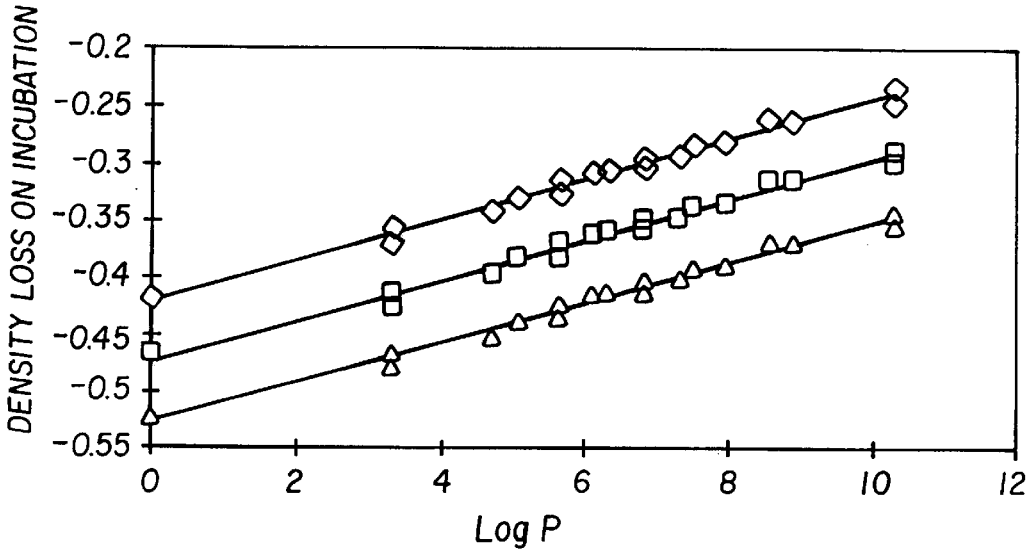
FIG. 1 is a graph showing the effect of polymer $\log P_{(calc)}$ value and polymer concentration on density loss after incubation.

Nucleation control is obtained by incorporating in the photographic material a polymeric material which can partition the nucleator to a greater or lesser degree, as quantified by the relative $\log P_{(calc)}$ values of the polymeric material and the nucleator, and thereby exactly control the nucleation effect. Thus if the $\log P_{(calc)}$ values of the polymeric material and nucleator are similar, the nucleation activity is reduced as the nucleator is strongly partitioned by the polymeric material. If the $\log P_{(calc)}$ values of the polymeric material and nucleator are significantly different, the nucleation activity is increased as the nucleator is partitioned to a lesser degree.

$\mathrm{Log}P_{(calc)}$ is the logarithm of the value of the octanol/water partition coefficient (P) of the compound which may be calculated using MedChem, version 3.54, a software package available from the Medicinal Chemistry Project, Pomona College, Claremont, Calif. $\mathrm{Log}P_{(calc)}$ is a parameter which is highly correlated with measured water solubility for compounds spanning a wide range of hydrophobicity. $\mathrm{Log}P_{(calc)}$ is a useful means to characterize the hydrophobicity of compounds.

The polymeric material capable of partitioning the nucleating agent may comprise a polymer derived from the polymerization of one or more ethylenically unsaturated monomers.

Suitable polymers may be selected from acrylates, methacrylates, acrylamides and methacrylamides, e.g., alkyl acrylates such as methyl acrylate and butyl acrylate, (methacryloyloxy)-ethylacetoacetate, and the sodium salt of 2-acrylamido-2-methylpropanesulfonic acid.

Suitable copolymers of the above monomers may be used, e.g., a copolymer of methyl acrylate, the sodium salt of 2-acrylamido-2-methylpropane sulfonic acid and 2-(methacryloyloxy)-ethylacetoacetate (88:5:7 by weight) and a copolymer of butyl acrylate, the sodium salt of 2-acrylamido-2-methylpropanesulfonic acid and 2-(methacryloyloxy)-ethylacetoacetate (90:4:6 by weight).

Preferably a blend of two or more of the above polymers or copolymers may be employed to provide a polymeric material having the desired partition coefficient.

The polymeric material may be present in an amount sufficient to appropriately partition the nucleator and to provide desired physical properties. The amount may be from 0.1 to 6 $g/m^2$, preferably from 0.2 to 1.5 $g/m^2$ and most preferably from 0.6 to 0.7 $g/m^2$.

Typically, polymers or blends thereof capable of producing $\log P_{(calc)}$ values in the range from 1 unit less than that of the nucleator to 10 units above, preferably from 0.5 unit less than that of the nucleator to 7 units above may be used.

The polymeric material may be present in a silver halide emulsion layer or an adjacent hydrophilic colloid layer. It may be present in more than one layer of the photographic material. It can be advantageous for the $\log P_{(calc)}$ of the polymer in one layer to be different from the $\log P_{(calc)}$ of the polymer in another layer in order to optimize the properties of the photographic material.

The ratio and quantities of the components of the blend may be varied in different coatings to provide a variety of $\log P_{(calc)}$ values, and therefore a variety of nucleation activities resulting in a variety of keeping and pepper fog performances. The blending of these polymers to produce specific partition qualities, as described by the $\log P_{(calc)}$ value of the mixtures, provides an otherwise unobtainable control of product performance.

In a preferred embodiment of the invention, the photographic material comprises two or more silver halide emulsion layers, each of which containing a different combination of polymers. In this way, the lower part of the imaging layers, which can have most effect on pepper fog and process sensitivity, can be treated differently to the remaining part of the imaging layer.

Preferably, the photographic material comprises a silver halide emulsion layer adjacent to the support and one or more silver halide emulsion layers coated thereon, each layer containing a polymeric material capable of partitioning the nucleator wherein the polymeric material in the layer adjacent the support partitions the nucleator to a greater extent than the polymeric material in a layer coated thereon.

Any hydrazine compound that functions as a nucleator and is preferably capable of providing, with an amine booster, a high contrast image on development at a pH below 11 may be used.

The hydrazine compound is incorporated in the photographic element, for example, it can be incorporated in a silver halide emulsion layer. Alternatively, the hydrazine compound can be present in a hydrophilic colloid layer of the photographic element, preferably a hydrophilic colloid layer which is coated to be adjacent to the emulsion layer in which the effects of the hydrazine compound are desired. It can, of course, be present in the photographic element distributed between or among emulsion and hydrophilic colloid layers, such as undercoating layers, interlayers and overcoating layers. The hydrazide and booster may be present in a non-latent image-forming emulsion layer.

Such hydrazine compounds may have the formula:

R—NHNHCHO wherein R is a phenyl nucleus having a Hammett sigma value-derived electron withdrawing characteristic of less than +0.30.

In the above formula, R can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values.

Examples of suitable nucleators are described in U.S. Pat. No. 5,512,415.

An especially preferred class of hydrazine compounds for use in the elements of this invention are sulfonamido-substituted hydrazines having one of the following structural formulae:

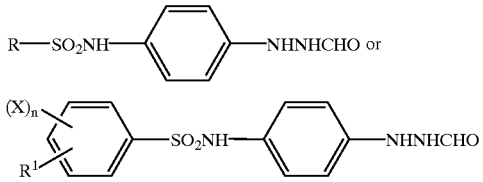

wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2R^2R^3$ where $R^2$ and $R^3$, which can be the same or different, are hydrogen or substituted or unsubstituted alkyl having from 1 to about 4 carbon atoms; and n is 0, 1 or 2.

Alkyl groups represented by R can be straight or branched chain and can be substituted or unsubstituted. Substituents include alkoxy having from 1 to 4 carbon atoms, halogen atoms (e.g., chlorine and fluorine), or —$NHCOR^2$— or —$NHSO_2R^2$— where $R^2$ is as defined above. Preferred R alkyl groups contain from 8 to 16 carbon atoms since alkyl groups of this size impart a greater degree of insolubility to the hydrazine nucleating agents and thereby reduce the tendency of these agents to be leached during development from the layers in which they are coated into developer solutions.

Heterocyclic groups represented by R include thienyl and furyl, which groups can be substituted with alkyl having from 1 to 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to 4 carbon atoms, halogen atoms (e.g. chlorine or fluorine); or —$NHCOR^2$ or —$NHSO_2R^2$ where $R^2$ is as defined above. Preferred alkyl or alkoxy groups contain from 1 to 5 carbon atoms in order to impart sufficient insolubility to the hydrazine nucleating agents to reduce their tendency to being leached out of the layers in which they are coated by developer solution.

Alkyl, thioalkyl and alkoxy groups which are represented by X contain from 1 to 5 carbon atoms and can be straight or branched chain. When X is halogen, it may be chlorine, fluorine, bromine or iodine. Where more than one X is present, such substituents can be the same or different.

Particularly preferred nucleators have the following formulae:

N1

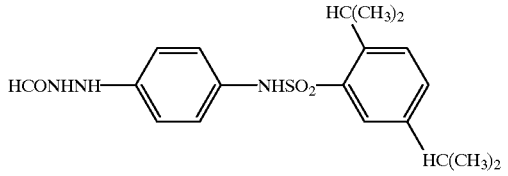

N2

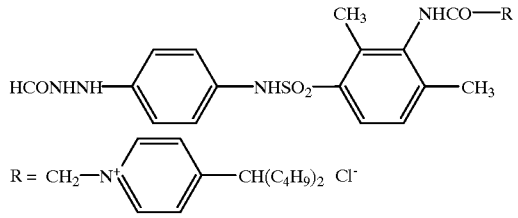

N3

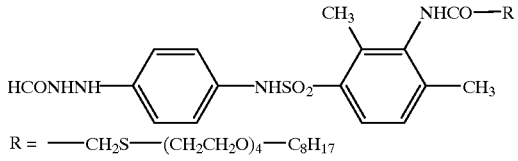

The present materials preferably contain an amine booster. Suitable amine boosters are described in U.S. Pat. No. 5,512,415 referred to above wherein they are defined as an amino compound which:

(1) comprises at least one secondary or tertiary amino group, (2) contains within its structure a group comprised of at least three repeating ethyleneoxy units, and (3) has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Included within the scope of the amino compounds utilized in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds of at least 20 carbon atoms. It is also preferred that the ethyleneoxy units are directly attached to the nitrogen atom of a tertiary amino group.

Preferably the partition coefficient is at least three, most preferably at least 4.

Preferred amino compounds for the purposes of this invention are bis-tertiary-amines which have a partition coefficient of at least three and a structure represented by the formula:

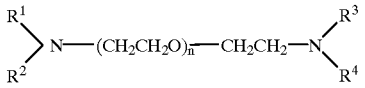

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another preferred group of amino compounds are bis-secondary amines which have a partition coefficient of at least three and a structure represented by the formula:

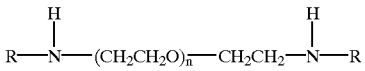

wherein n is an integer with a value of 3 to 50, and more preferably 10 to 50, and each R is, independently, a linear or branched, substituted or unsubstituted, alkyl group of at least 4 carbon atoms.

Particular amine boosters are listed in EP-A-0 364 166.

The photographic material comprises at least one latent image-forming silver halide emulsion layer. The latent image-forming emulsion may be bromoiodide, chlorobromoiodide, bromide, chlorobromide or chloride. It may contain dopants and is preferably spectrally sensitized. The emulsion is preferably chemically sensitized for example with both sulfur and gold.

The photographic material may further comprise at least one non latent image-forming silver halide emulsion layer. The non latent image-forming emulsion may be bromoiodide, chlorobromoiodide, bromide, chlorobromide or chloride. It may contain dopants. The emulsion is preferably chemically sensitized but not necessarily spectrally sensitized. Preferably, the non latent image-forming emulsion is coated closer to the support than the latent image-forming emulsion.

Preferably, both the non latent image-forming emulsion and the latent image-forming emulsion comprise at least 50 mole percent chloride, preferably from 50 to 100 mole percent chloride.

The grain size of the emulsion that forms the latent image preferably ranges from 0.05 to 1.0 $\mu$m in edge length, preferably from 0.05 to 0.5 $\mu$m and most preferably from 0.05 to 0.35 $\mu$m. The non-sensitive emulsion may have grain sizes in the same ranges but preferably smaller and in the range 0.05 to 0.5 $\mu$m and most preferably from 0.05 to 0.35 $\mu$m.

As is known in the graphics arts field, the silver halide grains may be doped with Rhodium, Ruthenium, Iridium or other Group VIII metals either alone or in combination. The emulsions may be negative or direct positive emulsions, mono- or poly-disperse.

Preferably the silver halide grains are doped with one or more Group VIII metals at levels in the range $10^{-9}$ to $10^{-3}$, preferably $10^{-6}$ to $10^{-3}$, mole metal per mole silver. The preferred Group VIII metals are Rhodium and/or Iridium.

The emulsions employed and the addenda added thereto, the binders, supports , etc. may be as described in Research Disclosure Item 308119, December 1989 published by Kenneth Mason Publications, Emsworth, Hants. United Kingdom (hereinafter referred to as *Research Disclosure*).

The hydrophilic colloid may be gelatin or a gelatin derivative, polyvinylpyrrolidone or casein and may contain a polymer. Suitable hydrophilic colloids and vinyl polymers and copolymers are described in Section IX of *Research Disclosure*. Gelatin is the preferred hydrophilic colloid.

The present photographic materials may contain an antihalation layer on either side of the support. It may be located between the emulsion layer(s) and the support. Alternatively, it may be located on the underside of the support. In a preferred embodiment an antihalation dye is contained in the hydrophilic colloid underlayer. The dye may be dissolved in the underlayer or, preferably, be present in the form of a dispersion of solid particles. Suitable dyes are listed in EP-A-0 364 166.

The photographic material may also contain a supercoat hydrophilic colloid layer which may also contain a vinyl polymer or copolymer located as the last layer of the coating (furthest from the support). It may contain some form of matting agent.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent.

Very high contrast images can be obtained at pH values below 11, preferably in the range of from 10.2 to 10.6, preferably in the range of 10.3 to 10.5, and especially at 10.4.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The invention is further illustrated by way of example as follows.

EXAMPLE 1

A photographic film was prepared consisting of a polyester (ESTAR™) support, an antihalation layer on the back of the support on which was coated a latent image forming silver halide emulsion layer, a gel interlayer and a protective supercoat.

A polymeric material of the appropriate $\log P_{(calc)}$ value (or a blend of chemicals which when mixed form the appropriate $\log P_{(calc)}$ value), is being added to the latent image forming emulsion layer to control the nucleation process, allowing the desired pepper fog and raw stock keeping performance to be achieved.

The latent image forming emulsion layer consisted of a 70:30 chlorobromide cubic monodispersed emulsion (0.18 μm edge length) doped with a rhodium salt at 0.168 mg/Ag mole, chemically sensitized with sulfur and gold and spectrally sensitized with 244 mg/Ag mole of sensitizing dye of the formula:

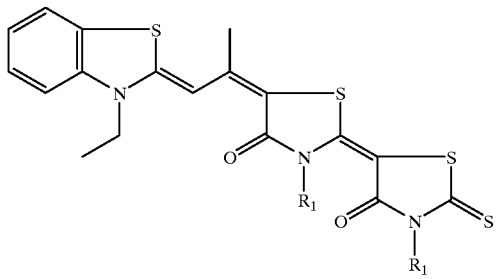

$R_1 = CH_2CO_2H$

The emulsion was coated at a laydown of 3.2 g Ag/m$^2$ in a vehicle of 2.1 g/m$^2$ gelatin and a blend of latex copolymer of methyl acrylate, the sodium salt of 2-acrylamido-2-methylpropane sulfonic acid and 2-(methacryloyloxy)-ethylacetoacetate (88:5:7 by weight), POL A, and butyl acrylate, the sodium salt of 2-acrylamido-2-methylpropanesulfonic acid and 2-(methacryloyloxy)-ethylacetoacetate (90:4:6 by weight), POL B, to form a mixture of the appropriate $\log P_{(calc)}$ value. Other addenda included $^2$-mercaptomethyl-5-carboxy-4-hydroxy-6-methyl-1,3,3a,7-tetraazaindene and 1-(3-acetamidophenyl)-5-mercaptotetrazole and a thickener to achieve the required viscosity.

The interlayer was coated at a gel laydown of 0.65 g/m$^2$ and included 6 mg/m$^2$ nucleator (structure I) having a $\log P_{(calc)}$ value of 3.31, 112 mg/m$^2$ amine booster (structure II), 0.183 g/m$^2$ latex copolymer of methyl acrylate, the sodium salt of $^2$-acrylamido-2-methylpropane sulfonic acid and 2-(methacryloyloxy)-ethylacetoacetate (88:5:7 by weight), POL A, and a thickener to achieve the required viscosity.

Structure I

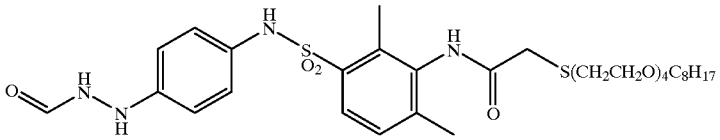

Structure II

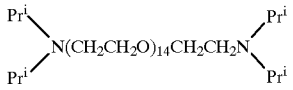

The supercoat contained matte beads and surfactants and was coated at a gelatin laydown of 1 g/m$^2$.

The coatings were evaluated by exposing through a 0.08 increment to a laser diode light source at 670 nm and then processed in KODAK™ RA2000 developer (diluted 1+2) at 35° C. for 30 seconds.

Coatings containing varying blends of the latex copolymers in the latent imaging forming layer (and therefore different $\log P_{(calc)}$ and polymer laydown values) were compared for pepper fog and raw stock keeping. The results may be seen in FIGS. 1 and 2.

Pepper fog was evaluated by processing an unexposed sample through a K710 processor containing RA2000 developer at 35° C. for 30 seconds and then, using a 50× lens (2 mm field), the number of pepper fog spots were counted in 3 fields and an average was taken.

Raw stock keeping was evaluated by calculating the change in Dmax after the samples were incubated in heat sealed packets for 7 days at 49° C. at ambient humidity.

Figure 2:
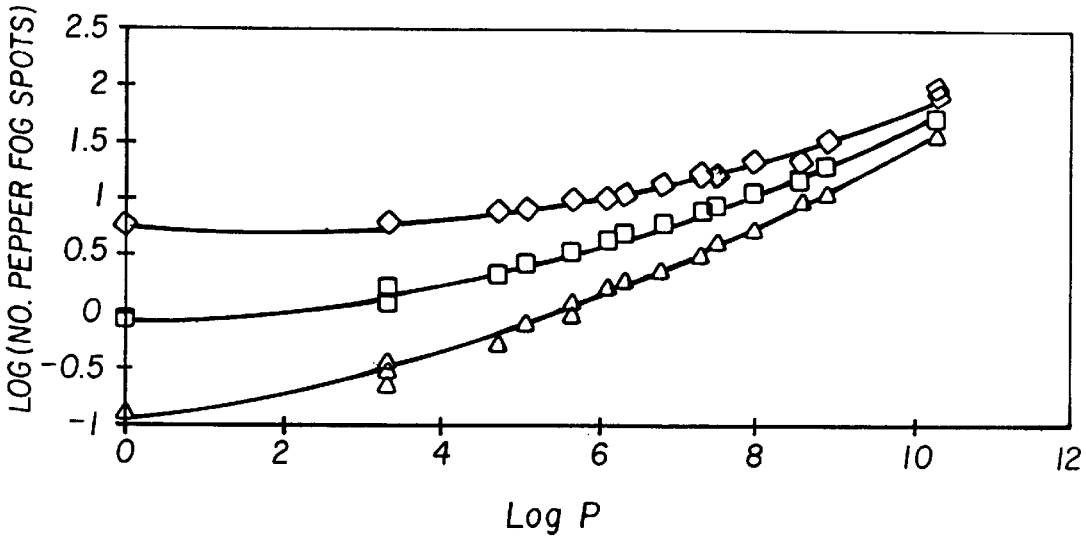
FIG. 2 is a graph showing the effect of polymer $\log P_{(calc)}$ value and polymer concentration on the number of pepper fog spots.

It can be seen from FIGS. 1 and 2 (the effect of $\log P_{(calc)}$ value and polymer concentration on density loss after incubation and log number of pepper fog spots respectively) that low $\log P_{(calc)}$ values or high polymer laydowns result in a small number of pepper fog spots. However, this results in poor raw stock keeping (large density loss after incubation).

In FIGS. 1 and 2, ♦ represents a polymer concentration of 0.314 g/m$^2$, ■ represents a polymer concentration of 0.627 g/m$^2$ and ▲ represents a polymer concentration of 0.941 g/m$^2$.

To achieve good raw stock keeping, high $\log P_{(calc)}$ values or low polymer laydowns are required. However, this results in a large number of pepper fog spots being formed.

By optimizing the $\log P_{(calc)}$ value and polymer laydown, the required response for both responses can be achieved.

EXAMPLE 2

A photographic film was prepared consisting of an polyester (ESTAR™) support, an antihalation layer on the back of the support on which was coated two non-latent image forming silver halide emulsion layers, a latent image forming silver halide emulsion layer, a gel interlayer and a protective supercoat.

The non-latent image forming emulsion coated next to the support consisted of a 70:30 chlorobromide cubic monodispersed emulsion (0.18 μm edge length) doped with a rhodium salt at 0.168 mg/Ag mole and chemically sensitized with sulfur and gold. The emulsion was coated at a laydown of 1.20 g Ag/m$^2$ in a vehicle of 0.877 g/m$^2$ gelatin and 0.289 g/m$^2$ of a blend of latex copolymers of methyl acrylate, the sodium salt of 2-acrylamido-2-methylpropane sulfonic acid and 2-(methacryloyloxy)-ethylacetoacetate (88:5:7 by weight), POL A, and butyl acrylate, the sodium salt of 2-acrylamido-2-methylpropanesulfonic acid and 2-(methacryloyloxy)-ethylacetoacetate (90:4:6 by weight), POL B to form the appropriate $\log P_{(calc)}$ value. Other addenda included 2-mercaptomethyl-5-carboxy-4-hydroxy-6-methyl-1,3,3a,7-tetraazaindene and 1-(3-acetamidophenyl)-5-mercaptotetrazole and a surfactant.

The second non-latent image forming emulsion coated as layer 2 above the support, consisted of a 70:30 chlorobromide cubic monodispersed emulsion (0.18 μm edge length) doped with a rhodium salt at 0.168 mg/Ag mole and chemically sensitized with sulfur and gold. The emulsion was coated at a laydown of 1.20 g Ag/m$^2$ in a vehicle of 0.745 g/m$^2$ gel and 0.146 g/m$^2$ of a blend of latex copolymers of methyl acrylate, the sodium salt of 2-acrylamido-2-methylpropane sulfonic acid and 2-(methacryloyloxy)-ethylacetoacetate (88:5:7 by weight), POL A, and butyl acrylate, the sodium salt of 2-acrylamido-2-methylpropanesulfonic acid and 2-(methacryloyloxy)-ethylacetoacetate (90:4:6 by weight), POL B to form the appropriate $\log P_{(calc)}$ value. Other addenda included 2-mercaptomethyl-5-carboxy-4-hydroxy-6-methyl-1,3,3a,7-tetraazaindene and 1-(3-acetamidophenyl)-5-mercaptotetrazole and a thickener to achieve the required viscosity.

The latent image forming emulsion layer consisted of a 70:30 chlorobromide cubic monodispersed emulsion (0.18 μm edge length) doped with a rhodium salt at 0.168 mg/Ag mole, chemically sensitized with sulfur and gold and spectrally sensitized with 244 mg/Ag mole of sensitizing dye of the formula:

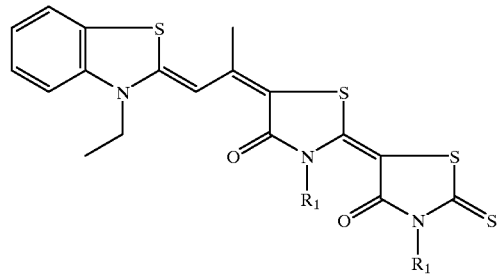

$R_1 = CH_2CO_2H$

The emulsion was coated at a laydown of 0.80 g Ag/m$^2$ in a vehicle of 0.478 g/m$^2$ gel and 0.158 g/m$^2$ latex copolymer of methyl acrylate, the sodium salt of 2-acrylamido-2-methylpropane sulfonic acid and 2-(methacryloyloxy)-ethylacetoacetate (88:5:7 by weight), POL A. Other addenda included 2-mercaptomethyl-5-carboxy-4-hydroxy-6-methyl-1,3,3a,7-tetraazaindene and 1-(3-acetamidophenyl)-5-mercaptotetrazole and a thickener to achieve the required viscosity.

The interlayer was coated at a gel laydown of 0.65 g/m$^2$ and included 6 mg/m$^2$ nucleator (structure I), 112 mg/m$^2$ amine booster (structure II), 0.183 g/m$^2$ latex copolymer of methyl acrylate, the sodium salt of 2-acrylamido-2-methylpropane sulfonic acid and 2-(methacryloyloxy)-ethylacetoacetate (88:5:7 by weight), POL A, and a thickener to achieve the required viscosity.

Structure I

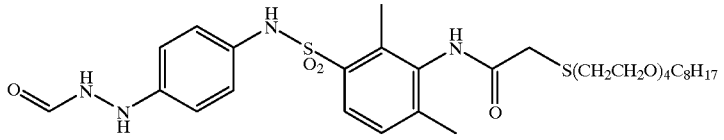

Structure II

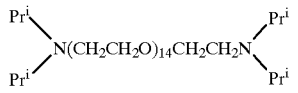

The supercoat contained matte beads and surfactants and was coated at a gel laydown of 1 g/m$^2$.

This coating was compared to one in which the latent image forming emulsion, dyed at the same rate per mole and providing a laydown of 0.64 g Ag/m$^2$ was dual melted with a single non-latent image forming emulsion providing a laydown of 2.56 g Ag/m$^2$ and coated as a single emulsion layer onto the support. A gel interlayer and supercoat identical to that described above were coated on top of the emulsion layer.

The coatings were evaluated by exposing through a 0.08 increment to a laser diode light source at 670 nm and then processed in KODAK™ RA2000 developer (diluted 1+2) at 35° C. for 30 seconds.

Both coatings achieved a maximum density of >5.2 demonstrating that the experimental coating had accessed the silver from both the layers containing the non-latent image forming emulsions. If the coating had not been able to access the silver in either one or both of the layers containing the non-latent image forming emulsion, the expected maximum density achieved would have been 3.12 or 1.04 respectively.

Eight coatings containing varying blends of the latex copolymers (i.e. mixtures with varying $\log P_{(calc)}$ values) in the two non-latent imaging forming layers were compared for pepper fog and raw stock keeping.

The results are recorded in Table 1 below which shows the effect of (calc) value on pepper fog and density loss after incubation.

TABLE 1

| Layer 1 | | | Layer 2 | | | | |
|---|---|---|---|---|---|---|---|
| % POL A | % POL B | Layer 1 $\log P_{calc}$ Value | % POL A | % POL B | Layer 2 $\log P_{calc}$ Value | No. Pepper Fog Spots | Delta Dmax After Inc |
| 75 | 25 | 5.09 | 25 | 75 | 8.58 | 3 | −0.60 |
| 75 | 25 | 5.09 | 75 | 25 | 5.09 | 1 | −1.02 |
| 50 | 50 | 6.83 | 0 | 100 | 10.32 | 3 | −0.43 |
| 50 | 50 | 6.83 | 50 | 50 | 6.83 | 3 | −0.80 |
| 50 | 50 | 6.83 | 100 | 0 | 3.34 | 2 | −1.07 |
| 25 | 75 | 8.58 | 25 | 75 | 8.58 | 6 | −0.63 |
| 25 | 75 | 8.58 | 75 | 25 | 5.09 | 3 | −0.70 |
| 0 | 100 | 10.32 | 50 | 50 | 6.83 | 13 | −0.51 |

Pepper fog was evaluated by processing an unexposed sample through a K710 processor containing RA2000 developer at 35° C. for 30 seconds and, then using a 50× lens (2 mm field), the number of pepper fog spots were counted in 3 fields and an average was taken.

Raw stock keeping was evaluated by calculating the change in Dmax after the samples were incubated in heat sealed packets for 7 days at 49° C. at ambient humidity.

It can be seen from the data in Table 1 that high $\log P_{(calc)}$ values produce a low number of pepper fog spots. However, this results in poor raw stock keeping (large density loss after incubation).

To achieve good raw stock keeping, low $\log P_{(calc)}$ values are required. However, this results in a large number of pepper fog spots being formed.

By optimizing the $\log P_{(calc)}$ value of the added chemical (or blend of chemicals) in both layers, the required response for both measurements can be achieved.

The invention has been described in detail with particular reference to certain preferred embodiments thereof, but it will be understood that variations and modifications can be effected within the spirit and scope of the invention.

We claim:

1. A high contrast photographic material, adapted for use in the field of graphic arts, comprising a support bearing at least one silver halide emulsion layer, and containing in said emulsion layer or in an adjacent hydrophilic colloid layer, a nucleating agent, said element further comprising a polymeric material capable of partitioning the nucleating agent, said polymeric material having a $\log P_{(calc)}$ value in the range from 1.78 to 10 units above that of said nucleator.

2. The material of claim 1 wherein said polymeric material is a product derived from the polymerization of one or more ethylenically unsaturated polymerizable monomers.

3. The material of claim 1 wherein said polymeric material is a blend of two or more polymers or copolymers.

4. The material of claim 1 wherein said polymeric material is present in an amount from 0.1 to 6 $g/m^2$.

5. The material of claim 1 wherein said polymeric material is present in more than one layer of said photographic material.

6. The material of claim 1 having a polymeric material in each of at least two layers of said photographic material, and the $\log P_{(calc)}$ of said polymeric material in one layer is different from the $\log P_{(calc)}$ of said polymeric material in another layer.

7. The material of claim 1 comprising a silver halide emulsion layer adjacent said support and one or more silver halide emulsion layers coated thereon, each layer containing a polymeric material capable of partitioning said nucleator, wherein said polymeric material in said layer adjacent said support partitions said nucleator to a greater extent than said polymeric material in a layer coated thereon.

8. The material according to claim 7 wherein said silver halide emulsion layer adjacent the support comprises a non latent image-forming emulsion.

* * * * *